US006355850B1

(12) United States Patent
Angelo et al.

(10) Patent No.: US 6,355,850 B1
(45) Date of Patent: Mar. 12, 2002

(54) MANUFACTURE OF ELECTRICAL OIL ENRICHED WITH HYDROFINED GAS OIL FOR IMPROVED OXIDATION AND ELECTRICAL RESISTANCE

(75) Inventors: Jacob Ben Angelo, Spring, TX (US); Thomas Lynn Bays, Baton Rouge, LA (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/483,973

(22) Filed: Jan. 18, 2000

(51) Int. Cl.[7] ..... H01B 3/22; C10G 21/00; C10G 67/04

(52) U.S. Cl. ..... 585/6.6; 585/6.3; 208/14; 208/87; 208/211; 252/570; 252/574

(58) Field of Search ..... 585/6.3, 6.6; 208/14, 208/87, 211; 252/570, 574

(56) References Cited

U.S. PATENT DOCUMENTS 3,617,473 A * 11/1971 Lipscomb, II ..... 208/14
3,625,878 A * 12/1971 Gourlaouen et al. ..... 208/14
3,839,188 A * 10/1974 Mills et al. ..... 208/14
3,904,507 A * 9/1975 Mills ..... 208/14
3,925,220 A * 12/1975 Mills ..... 252/578
3,932,267 A * 1/1976 Lewis et al. ..... 208/87
4,033,854 A * 7/1977 Ohmori et al. ..... 208/14
4,069,166 A * 1/1978 Masunaga et al. ..... 585/6.6
4,072,620 A * 2/1978 Masunaga et al. ..... 585/6.6
4,170,543 A * 10/1979 Lipscomb, II et al. ..... 208/14
4,542,246 A * 9/1985 Matsunaga et al. ..... 585/6.6
4,584,129 A * 4/1986 Katayama ..... 252/570
4,731,495 A * 3/1988 Katayama ..... 585/6.6
4,770,763 A * 9/1988 Kusayanagi et al. ..... 208/18

FOREIGN PATENT DOCUMENTS

JP 09-272891 A * 10/1997
JP 11-329079 A * 11/1999

* cited by examiner

*Primary Examiner*—Walter D. Griffin
(74) *Attorney, Agent, or Firm*—Charles J. Brumlik

(57) ABSTRACT

Electrical oils having improved uninhibited oxidation and electrical resistance are derived by blending a substantially nitrogen and sulfur free paraffinic or naphthenic base oil with a hydrofined light gas oil having a sulfur to nitrogen weight ratio of greater than 100:1 wherein the hydrofined light gas oil is added to the base oil in an amount sufficient to provide a blend having greater than about 0.03 wt % sulfur.

12 Claims, No Drawings

MANUFACTURE OF ELECTRICAL OIL ENRICHED WITH HYDROFINED GAS OIL FOR IMPROVED OXIDATION AND ELECTRICAL RESISTANCE

FIELD OF THE INVENTION

The present invention relates to electrical oils. More particularly the present invention relates to electrical oils derived from paraffinic or naphthenic distillates that have been treated to be substantially sulfur free and from a hydrofined light gas oil.

BACKGROUND OF THE INVENTION

Generally, electrical oils are prepared from naphthenic crude oils by a variety of processes. In one process, a vacuum distillate of a naphthenic crude is solvent extracted with phenol to remove polycondensed ring aromatics, nitrogen and sulfur compounds and then is hydrofined to impart good color, odor and oxidation stability and electrical properties. Electrical oils produced in this manner normally meet or exceed requisite performance conditions exemplified by ASTM D 3487 and ASTM D 2440.

In another process, a vacuum distillate is hydrotreated under conditions which increase saturates and removes nitrogen compounds and up to about 90% of sulfur compounds. To meet the oxidation requirements of an electrical oil, a synthetic oxidation inhibitor, such as 2, 6 di-t-butyl phenol or 2, 6 di-t-butyl cresol then is added to the thus hydrotreated distillate.

SUMMARY OF THE INVENTION

It now has been discovered that an electrical oil having excellent oxidation stability, impulse breakdown strength and gassing tendency in the absence of added oxidation inhibitor is obtained by blending a substantially sulfur free paraffinic or naphthenic base oil boiling in the electrical oil range with a hydrofined light gas oil having a sulfur to basic nitrogen ratio greater than 100:1, the amount blended being an amount sufficient to provide a blend having a greater than about 0.03 wt % sulfur.

DETAILED DESCRIPTION

In preparing the blended electrical oil of the present invention a substantially nitrogen and sulfur free base oil obtained by treating a paraffinic or naphthenic distillate boiling in the electrical oil range, for example in the range of 225° C. to 480° C. at atmospheric pressure, is employed. Typically such base oils will have less than about 500 ppm sulfur, for example 50 to 300 ppm and less than about 25 ppm basic nitrogen, i.e., between about 1 to 5 ppm. Examples of such base oils are those that have been treated or obtained from distillates that have been treated under conditions that substantially lower the nitrogen and sulfur compounds present in the base oil or distillate and increase the saturates present to greater than 75 wt % as determined by clay gel . Thus in one embodiment, a suitable paraffinic or naphthenic distillate is obtained by distilling a crude oil feedstock. The resultant distillate is then treated with an aromatic selective solvent such as phenol, N-methyl pyrolidone, or furfural, to remove aromatic compounds and to decrease the amount of nitrogen and sulfur compounds present. Such solvent extraction is well known. Typical extracting temperatures are in the range of 50° C. to 100° C. and the volume ratios of solvent to distillate in the range of 1:1 to 2:1.

The solvent extracted distillate is next hydrofined under known hydrofining conditions to lower the basic nitrogen levels in the distillate to less than 25 ppm, typically below about 10 ppm and preferably between about 1 ppm to about 5 ppm. As is well known, basic nitrogen compounds are those that can be titrated with perchloric acid using acetic acid as a solvent in contrast to other nitrogen compounds present in the oil which are not titratable. Typical hydrofining conditions for the solvent extracted distillate are given in Table 1.

TABLE 1

Solvent Extracted Distillate Hydrofining Conditions

| | Broad Range | Preferred |
|---|---|---|
| Space Velocity, v/v/hr | 1.0–3.0 | 1.5–2.5 |
| $H_2$ Pressure, psig | 400–1000 | 600–800 |
| Temperature, ° C. | 330–370 | 340–355 |
| $H_2$ Rate, SCF/B | 400–800 | 500–700 |

The substantially sulfur free treated distillate is then blended with a light gas oil (LGO). Typically the LGO is one boiling in the range of about 200° C. to 400° C. at atmospheric pressure, i.e., the LGO distillate employed is one having a minimum flash point of 140° C., preferably greater than 145° C. and a viscosity of about 40 SUS@ 100° F.

The LGO distillate preferably is one that has been hydrofined to improve color and odor and reduce the basic nitrogen level, while maintaining a sulfur (S) to basic nitrogen (BN) weight ratio of greater than 100:1 and preferably greater than about 200:1. Typical conditions for carrying out this hydrofining are shown in Table 2.

TABLE 2

LGO Hydrofining Conditions

| | Broad Range | Preferred |
|---|---|---|
| Space Velocity, v/v/hr | 0.5–2.0 | 0.5–1.0 |
| $H_2$ Pressure, psig | 400–1000 | 500–800 |
| Temperature, ° C. | 275–350 | 295–315 |
| Hydrogen Rate, SCF/B | 300–800 | 450–600 |

The resultant hydrofined LGO is added to the solvent refined distillate in an amount sufficient to provide an electrical oil having greater than 0.03 wt % sulfur, for example between 0.03 wt % to 1 wt % and preferably from about .05 wt % to about 0.2 wt %. Typically the volume ratio of solvent extracted and hydrofined distillate to hydrofined LGO will be in the range of about 75:25 to about 25:75.

In order to obtain an electrical oil having a desired pour point, a pour point depressant such as an alkylated polystyrene may be added to the blended composition. Alternatively, the solvent extracted and hydrofined distillate may be subjected to solvent or catalytic dewaxing before blending with the LGO. In yet another embodiment the blended composition may be subjected to solvent or catalytic dewaxing.

The oxidation stability of the composition of the present invention can be even further enhanced by the addition of a minor but effective amount of an oxidation inhibitor such as 2,6 di-t-butyl phenol and 2,6 di-t-butyl cresol. Thus for a Type I electrical oil less than 0.08 wt % of inhibitor may be added and for a Type II oil less than about 0.3 wt %.

EXAMPLES

In the examples which follow a commercially available solvent refined and dewaxed 75N paraffinic base oil was used. The paraffinic base oil had the properties listed in Table 3 below.

TABLE 3

PROPERTIES OF 75N PARAFFINIC BASE OIL

| DESCRIPTION | 75 N NMP EXTRACTED, HYDROFINED, DEWAXED |
|---|---|
| PHYSICAL PROPERTIES | |
| API Gravity | 35.7 |
| Specific Gravity, 60/60° F. | 0.8461 |
| Density, 15° C., g/cc | 0.8457 |
| Viscosity @ 40° C., cSt/SSU | 13.0/69.9 |
| Viscosity Index | 104 |
| Refractive Index @ 75° C. | 1.4455 |
| Aniline Point, ° C. | 101 |
| Pour Point, ° C. | −18 |
| Cloud Point, ° C. | −17 |
| Appearance | Bright and Clear |
| Color, ASTM | 0.5 |
| Flash Point (COC), ° C. | 182 |
| Saturates by Clay Gel, wt % | 86.0 |
| Sulfur, wt % | 0.03 |
| Basic Nitrogen, wppm | 5 |
| Sulfur/Basic N ratio | 60:1 |
| CHEMICAL PROPERTIES | |
| ASTM D 2440 Oxidation Stability Inhibitor, DBPC, wt % | None |
| 164 Hours: | |
| Sludge, wt % | 1.24 |
| Neutralization value, mgKOH/gt | 7.80 |

Also, in the examples a 40 SSU at 100° F. LGO which was hydrofined under conditions A and B listed in Table 4 was used. The properties of the hydrofined LGO also are listed in Table 4 below.

TABLE 4

PROPERTIES OF HYDROFINED LGO

| Hydrofined Condition Number | HLGO-4 | HLGO-6 |
|---|---|---|
| HYDROFINING CONDITION [1] | A | B |
| Temperature, ° C. (° F.) | 295 (563) | 315 (599) |
| LHSV, V/HR/V | 0.5 | 1.0 |
| PHYSICAL PROPERTIES | | |
| API Gravity, 60/60° F. | 35.6 | 36.0 |
| Specific Gravity, 60/60° F. | 0.8467 | 0.8445 |
| Vis @ 40° C. cSt/SSU | 4.68/41.4 | 4.49/40.8 |
| Viscosity Index | 97 | 95 |
| Refractive Index @ 20° C. | 1.4698 | 1.4690 |
| Aniline Point, ° C. | 77 | 76 |
| Pour Point, ° C. | −4 | −4 |
| ASTM Color, (Saybolt) | +22 | +22 |
| Flash Point (COC), ° C. | 138 | 143 |
| Saturates by Clay Gel, wt % | 72.7 | 74.3 |
| Sulfur, wt % | 0.34 | 0.23 |
| Basic Nitrogen, ppm | 15 | 20 |
| Sulfur/Basic N ratio (wt/wt) | 227 | 115 |

[1] Other HF Conditions: 550 psig @ 100% H2, 500 SCF/B gas treat.

The electrical properties of the 75N paraffinic base oil and the LGO's hydrofined under conditions A and B are given in Table 5 below. Also included in Table 5 are the ASTM D 3487 electrical oil specifications for those properties. The 75N has excellent impulse strength, but exhibits positive gassing which is undesirable for an electrical oil. The hydrofined LGO has excellent negative gassing properties and a high impulse strength, but too low a viscosity and flash point to be useful by itself as an electrical oil.

TABLE 5

ELECTRICAL PROPERTIES OF 75N AND HYDROFINED LGO

| DESCRIPTION | 75N NMP EXTRACTED | HYDROFINED LGO CONDITION A | HYDROFINED LGO CONDITION B | ASTM D 3487 SPECS |
|---|---|---|---|---|
| Impulse Breakdown Voltage @ 25° C., kv Needle (negative) to sphere (grounded), @ 1 - in Gap | >300 | 190 | ND | 145 min. |
| Gassing Tendency @ 80° C., μL/min | +19.3 | −36.6 | −38.8 | +30 max |

ND = not determined

Examples 1 and 2

Various blends were prepared from the solvent refined, dewaxed paraffinic base oil and the hydrofined LGO which improved both the oxidation stability and the gassing tendency of the 75N NMP paraffinic base oil. The proportion of ingredients and the properties of the blends are given in Table 6. The blends contained a pour point depressant to improve the low temperature properties of the oil.

TABLE 6

PARAFFINIC ELECTRICAL OIL BLENDS OF 75N (NMP) WITH HYDROFINED LGO (HLGO)

| DESCRIPTION | BLEND 1 | BLEND 2 | ASTM D 3487 SPECS |
|---|---|---|---|
| 75 N (NMP) BAS OIL | 56.7 | 56.7 | |
| HLGO, CONDITION A, wt % | 42.7 | | |
| HLGO, CONDITION B, wt % | | 42.7 | |
| Pour Point Depressant, Ferro[1] OA-102, wt % (50% active) | 0.60 | 0.60 | |
| PHYSICAL PROPERTIES | | | |
| API gravity, 60/60° F. | 35.5 | 35.7 | |
| Specific gravity, 60/60° F. | 0.8472 | 0.8465 | 0.91 max |
| Density, 15° C. | 0.8469 | 0.8461 | |
| Viscosity @ 40° C., cSt/SSU | 8.02/52.2 | 8.21/52.8 | 12/66 |
| Viscosity Index | 97 | 103 | |
| Aniline point, ° C. | 90 | 91 | 63–84 |
| Pour point, ° C. | | −30 | −40 max |
| Flash point (COC), ° C. | 157 | 159 | 145 min |
| Saturates by Clay Gel, wt % | 77.9 | 78.6 | |
| Sulfur, wt % | 0.17 | 0.11 | |
| Basic Nitrogen, ppm | 9 | 5 | |
| Sulfur/Basic N ratio (wt/wt) | 190:1 | 220:1 | |
| CHEMICAL PROPERTIES | | | |
| ASTM D 2440 Oxidation Stability @ 110° C. Inhibitor, DBPC, wt % | None | None | |
| 72 Hours: | | | |
| Sludge, wt % | 0.021 | 0.032 | 0.15 max |
| Neutralization value, mgKOH/g | 0.226 | 0.350 | 0.50 max |
| 164 Hours | | | |
| Sludge, wt % | 0.039 | 0.038 | 0.30 max |
| Neutralization value, mgKOH/g | 0.226 | 0.327 | 0.60 max |
| 336 Hours: | | | |
| Sludge, wt % | 0.054 | 0.056 | |
| Neutralization value, mgKOH/g | 0.232 | 0.332 | |
| ELECTRICAL PROPERTIES | | | |
| Dielectric Breakdown Voltage | | 53 | 30 min |

TABLE 6-continued

PARAFFINIC ELECTRICAL OIL BLENDS OF 75N (NMP) WITH HYDROFINED LGO (HLGO)

| DESCRIPTION | BLEND 1 | BLEND 2 | ASTM D 3487 SPECS |
|---|---|---|---|
| @ 60, Hz, kV | | | |
| Impulse Breakdown Voltage @ 25° C., Kv Needle (negative)-to-sphere (grounded), @ 1-in Gap | | 214 | 145 min |
| Gassing Tendency @ 80° C., μL/min | | −21.8 | +30 max |
| Power Factor @ 60 Hz, % | | | |
| 25° C. | | 0.015 | 0.05 max |
| 90° C. | | 0.090 | |
| 100° C. | | 0.108 | 0.30 max |
| Static Charge Density, $\mu C/m^3$ | | 42 | |

(1)Ferro OA-102 is an alkylated polystyrene pour point depressant sold by Ferro Corporation, Hammond, IN.

Examples 3 and 4

Two blends were prepared from solvent refined dewaxed paraffinic base oil and a hydrofined LGO which included an added oxidation inhibitor. The preparation of ingredients and the oxidation resistance of the blends is given in Table 7.

TABLE 7

PARAFFINIC ELECTRICAL OIL BLENDS OF 75N (NMP) WITH HYDROFINED LGO (HLGO) AND ANTIOXIDANT

| DESCRIPTION | BLEND 1 | BLEND 2 | ASTM D 3487 SPECS |
|---|---|---|---|
| 75 N (NMP) BASE OIL | 56.62 | 56.62 | |
| HLGO, CONDITION A, wt % | 42.72 | | |
| HLGO, CONDITION B, wt % | | 42.72 | |
| Pour Point Depressant, Ferro (1) OA-102, wt % (50% active) | 0.60 | 0.60 | |
| ASTM D 2440 Oxidation Stability @ 110° C. Inhibitor, DBPC (2), wt % | 0.06 | 0.06 | |
| 72 Hours: | | | |
| Sludge, wt % | 0.010 | 0.011 | 0.15 max |
| Neutralization value, mgKOH/g | 0.0 | 0.0 | 0.50 max |
| 164 Hours | | | |
| Sludge, wt % | 0.019 | 0.039 | 0.30 max |
| Neutralization value, mgKOH/g | 0.190 | 0.324 | 0.60 max |
| 336 Hours: | | | |
| Sludge, wt % | 0.044 | 0.079 | |
| Neutralization value, mgKOH/g | 0.167 | 0.356 | |

(1) Ferro OA-102 is an alkylated polystyrene pour point depressant sold by Ferro Corporation, Hammond, IN.
(2) 2,6-Di-t-butyl cresol.

As can be seen, the low level of oxidation inhibitor nonetheless provides additional oxidation resistance for the blends.

What is claimed is:

1. An electrical oil comprising a blend of: (A) a substantially nitrogen and sulfur free, paraffinic or naphthenic base oil boiling in the electrical oil boiling range, and (B) a hydrofined light gas oil (LGO) boiling in the range of about 200° C. to about 400° C. and having a sulfur to basic nitrogen ratio (S/BN) greater than 100:1, the hydrofined LGO being present in an amount sufficient to provide a blend having greater than about 0.03 wt % sulfur.

2. The oil of claim I wherein the base oil has a sulfur content below about 500 ppm and a basic nitrogen content below about 25 ppm.

3. The oil of claim 1 wherein the LGO has a S/BN greater than 200:1.

4. The oil of claim 1 wherein the base oil is a solvent extracted, hydrofined distillate having a basic nitrogen content below about 5 ppm.

5. The oil of claim 4 wherein the hydrofined distillate is dewaxed.

6. The oil of claim 5 wherein the distillate is a paraffinic distillate.

7. A method for preparing an electrical oil comprising:

solvent extracting a paraffinic or naphthenic distillate boiling in the electrical oil boiling range to remove aromatic compounds and to decrease the nitrogen and sulfur compounds;

hydrofining the solvent extracted distillate;

hydrofining a light gas oil (LGO) boiling in the range of about 200° C. to about 400° C. to provide a hydrofined light gas oil having a sulfur to basic nitrogen ratio of greater than 100:1;

adding the hydrofined LGO to the distillate in an amount sufficient to provide a blend having greater than about 0.03 wt % sulfur.

8. The method of claim 7 wherein the solvent extracted distillate is hydrofined to provide a distillate having less than about 5 ppm basic nitrogen.

9. The method of claim 8 wherein the distillate is a paraffinic distillate.

10. The method of claim 9 including the step of dewaxing one of (a) the hydrofined distillate or (b) the blend.

11. A method for increasing the oxidation stability of an oil boiling in the electrical oil boiling range and having from about 50 to about 300 ppm sulfur and from about 1 to about 25 ppm nitrogen, the method comprising adding to the oil a hydrofined light gas oil boiling in the range of about 200° C. to about 400° C. and having a sulfur to basic nitrogen ratio greater than 100:1, the light gas oil being added in an amount sufficient to provide a blend having greater than 0.03 wt % sulfur.

12. The method of claim 11 wherein the light gas oil is added in an amount sufficient to provide a blend having from about 0.05 wt % to about 0.2 wt % sulfur.

* * * * *